United States Patent [19]

Pitocchi

[11] 4,050,155

[45] Sept. 27, 1977

[54] CAN OPENER GUN

[75] Inventor: Omero Pitocchi, Jersey City, N.J.

[73] Assignee: The Raymond Lee Organization, Inc., New York, N.Y.

[21] Appl. No.: 656,297

[22] Filed: Feb. 9, 1976

[51] Int. Cl.[2] ..... B67B 7/30

[52] U.S. Cl. ..... 30/400; 30/426; 81/57.39

[58] Field of Search ..... 30/8, 8.5, 9, 14, 15, 30/15.5, 400, 434; 81/57.39

[56] References Cited

U.S. PATENT DOCUMENTS

| | | | |
|---|---|---|---|
| 2,661,528 | 12/1953 | Coplen | 30/15 X |
| 2,711,581 | 6/1955 | Lacey | 30/15 |
| 2,718,056 | 9/1955 | Burnett | 30/15.5 |
| 2,817,257 | 12/1957 | Kniser | 81/57.39 X |

FOREIGN PATENT DOCUMENTS

| | | | |
|---|---|---|---|
| 340,266 | 9/1921 | Germany | 30/15.5 |
| 1,326,094 | 12/1963 | France | 30/9 |

*Primary Examiner*—Gary L. Smith
*Attorney, Agent, or Firm*—Howard I. Podell

[57] ABSTRACT

A portable can opener tool shaped as a gun, with an elongated trigger pivoted to a butt handle. Pulling of the trigger to the butt of the handle serves to rotate a can past the blade of the tool so as to cut the top of the can away from the can rim. The tool incorporates a basic frame member to which a cutter frame is pivoted at the front end of the basic frame with both the basic frame and cutter frame extending to form butt handle ends which are drawn together to clamp the cutter blade into a can top. The trigger is pivoted to the basic frame and pivotably joined to a pusher arm which bears against radial members of a shaft fixed to a rachet wheel, or alternately, the pusher arm is fitted with rachet teeth for directly bearing against the rim of a can to be rotated against the cutter blade. The cutter blade may be in the form of a free turning wheel.

2 Claims, 11 Drawing Figures

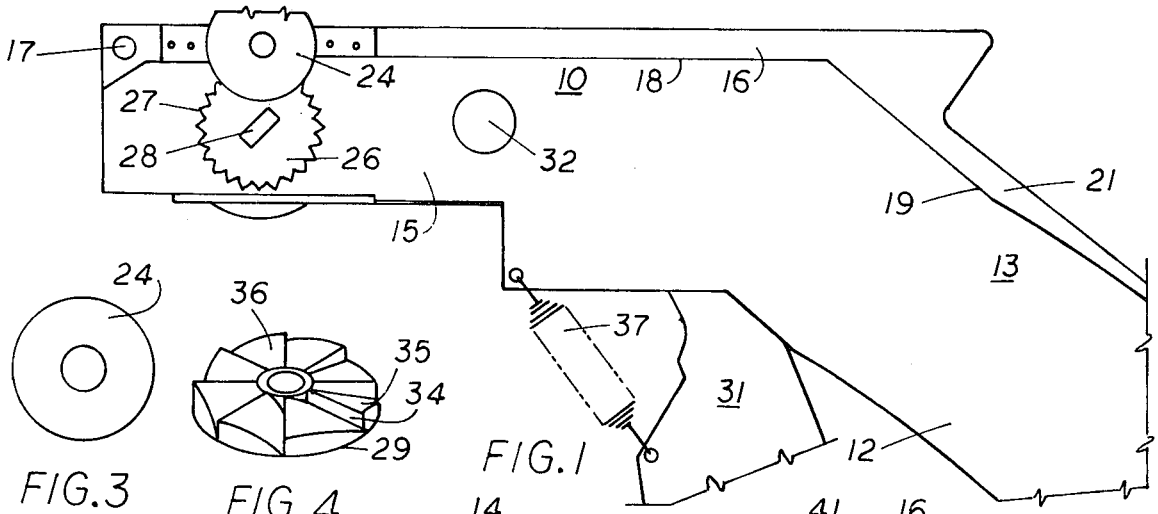
FIG. 1
FIG. 3
FIG. 4
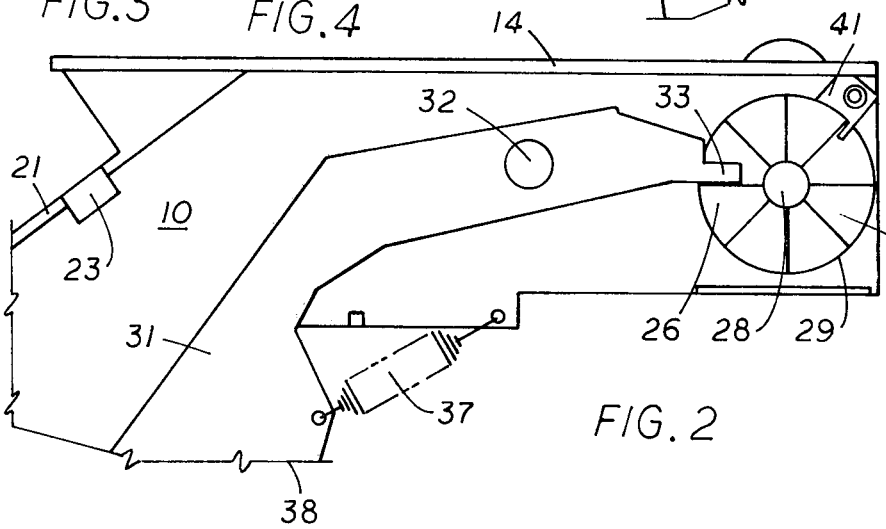
FIG. 2
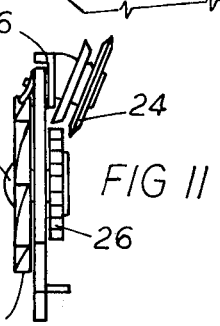
FIG 11
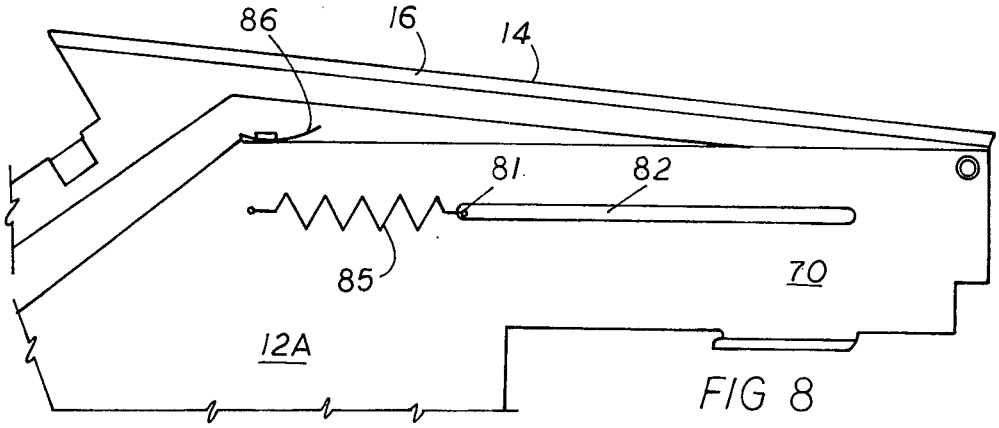
FIG 8

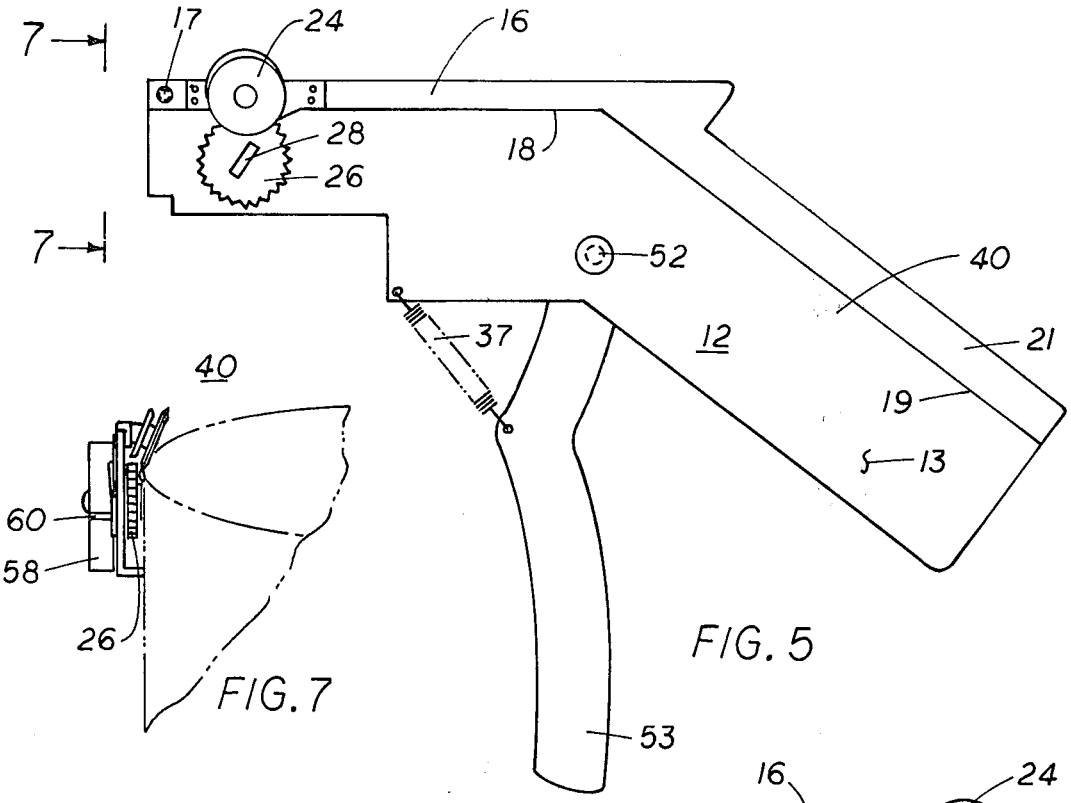
FIG. 5
FIG. 7
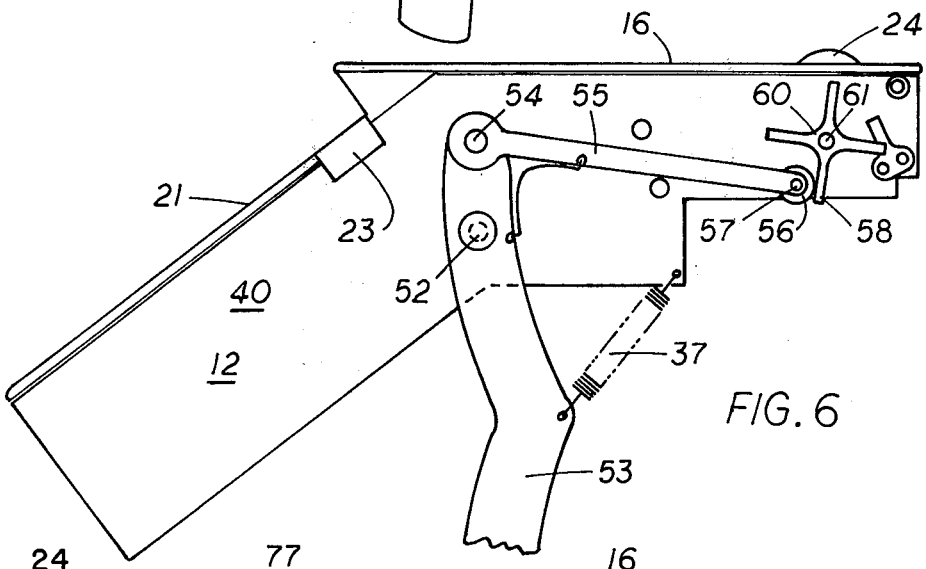
FIG. 6
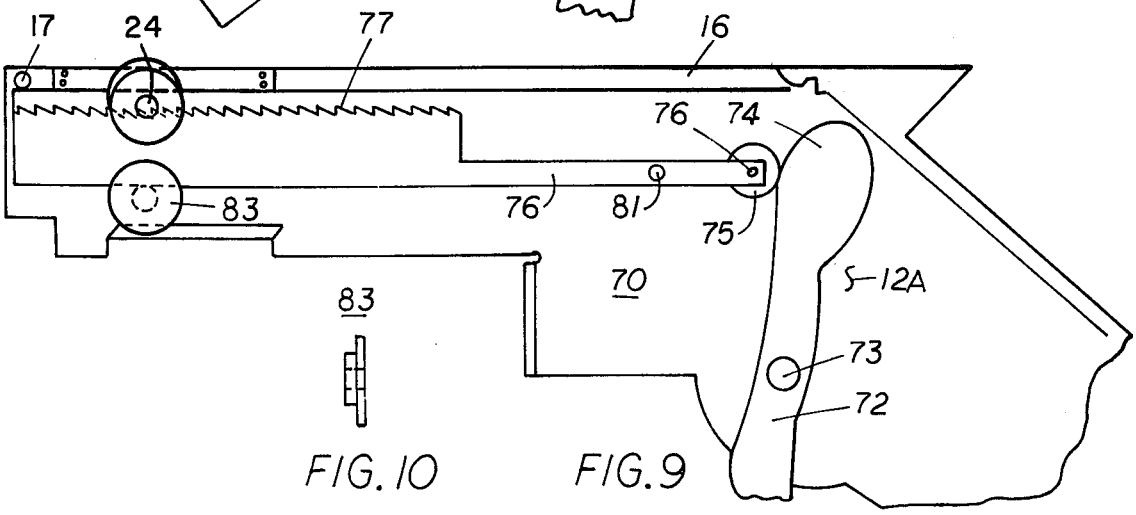
FIG. 10
FIG. 9

CAN OPENER GUN

SUMMARY OF THE INVENTION

My invention is a portable can opener tool shaped as a gun, with an elongated trigger pivoted to a butt handle. Pulling of the trigger to the butt of the handle serves to rotate a can past the blade of the tool so as to cut the top of the can away from the can rim. The tool incorporates a basic frame member to which a cutter frame is pivoted at the front end of the basic frame with both the basic frame and cutter frame extending to form butt handle ends which are drawn together to clamp the cutter blade into a can top. The trigger is pivoted to the basic frame and pivotably joined to a pusher arm which bears against radial members of a shaft fixed to a rachet wheel, or alternately, the pusher arm is fitted with rachet teeth for directly bearing against the rim of a can to be rotated against the cutter blade. The cutter blade may be in the form of a free turning wheel.

In use, the cutter frame of the tool is pivoted towards the basic frame so as to pierce a can top resting under the cutter blade and the trigger is pulled to rotate the rim of the can so as to move the blade through the circumference of the can top.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a fragmentary left hand elevation view of the invention;

FIG. 2 is a fragmentary right hand elevation view of the invention;

FIG. 3 is an elevation view of the cutter wheel;

FIG. 4 is an elevation view of the drive wheel;

FIG. 5 is a left hand elevation view of a first alternate embodiment of the invention;

FIG. 6 is a right hand elevation view of the first alernate embodiment;

FIG. 7 is an end view taken along line 7—7 of FIG. 5;

FIG. 8 is a right hand fragmentary elevation view of a second alternate embodiment;

FIG. 9 is a left hand fragmentary elevation view of a second alternate embodiment;

FIG. 10 is a side view of a guide wheel of the second alternate embodiment; and

FIG. 11 is a front end view of the preferred embodiment of the invention.

DESCRIPTION OF THE PREFERRED EMBODIMENT

Turning now descriptively to the drawings, in which similar reference characters denote similar elements throughout the several views, FIGS. 1–4 and 11 illustrate the preferred embodiment of the tool 10 which is formed of a basic frame 12 in the general outline shape of a pistol, with a butt handle end 13 oriented at an obtuse angle to the forward frame end 15. A cutter frame 16 is pivoted by a rivet 17 to the upper forward end of the basic frame 12 and shaped to rest, in the closed position, against the top edge 18 of the forward frame end 15 with the butt end 21 of the cutter frame resting against the top edge 19 of the butt handle end 13 of the basic frame 12. Cutter frame 16 is pivotably away from the top edge 18 of the forward frame end 15 to separate a cutter wheel 24 rotatably mounted to the cutter frame 16 from the toothed drive wheel 26, preliminary to fitting a can (not shown) with the can top rim between the cutter wheel 24 and the toothed drive wheel 26.

Drive wheel 26 is fitted on its circumference with sharp teeth 27 and fixed to a shaft 28 that is fixed to rachet wheel 29 so that rotation of rachet wheel 29 rotates drive wheel 26.

A trigger bar 31 is pivotably mounted to the basic frame 12 by a rivet 32 and shaped on one end to extend below and forward of the butt handle end 13 of the basic frame 12 with the other end of the trigger bar 31 shaped as a tooth 33 to bear against the projecting edge 34 of one of a plurality of tapered rachet teeth 36 formed on the external side of the rachet wheel 29. A tension spring 37 is fixed to the butt end 38 of the trigger bar 31 and to the basic frame 12 to bias the butt end 38 of the trigger bar 31 away from the butt end 13 of the basic frame 12. Manual operation of the trigger bar 31 to pull the butt end 38 of the trigger bar towards the butt end 13 of the basic frame serves to rotate rachet wheel for a fractional revolution, with a series of such strokes serving to rotate the toothed drive wheel 26 sufficiently to rotate a gripped can rim completely about the cutter wheel 24 so as to open the can top. A flat spring 41 fixed to the basic frame 12 engages an external rachet tooth 36 to prevent reverse rotation of rachet wheel 29.

Cutter frame 16 is formed with a flange 14 which is bent over to engage the top edge 18 of the basic frame 12 when the cutter frame 16 is pivoted adjacent to the basic frame 12. A clip flange 23 on the butt end 21 of the cutter frame 16 fits about the top edge 19 of the butt end 13 of the basic frame, in the closed position.

FIGS. 5–7 illustrate a first alternate embodiment in the form of the tool 40 which is generally similar to tool 10 but for the substitution of a paddle wheel 60 for rachet wheel 29 and an alternate trigger mechanism. Trigger handle 53 is pivoted by a rivet 52 to the basic frame 12 which is pivotably joined by rivet 54 to pusher rod 55. A free-spinning wheel 56 mounted by pin 57 at the free end of pusher rod 55 bears against a radial arm 58 of a paddle shaped wheel 60 fixed to rotatable shaft 61, with shaft 61 fixed to toothed drive wheel 26.

FIGS. 8–9 illustrate a second alternate embodiment in the form of the tool 70. A basic frame 12A is pivotably mounted to the cutter frame 16 by pin 17 with a rotatable cutter wheel 24 mounted to the cutter frame 16.

Trigger bar 72 is pivotably mounted to basic frame 12A by pin 73 with the trigger bar 72 formed with a rounded cam-shaped end 74 which bears against a bearing wheel 75 rotatably pinned to the end of pusher bar 76. Pusher rod 76 is formed on its upper edge with a series of serrated teeth 77 that grip the external undersurface of the rim of a can to be pushed under cutter wheel 24. Pusher rod 76 is fitted with a pin 81 that rides in a slot 82 of the basic frame 12A and the rod 76 is further guided by flanged guide wheel 83 rotatably mounted opposite cutter blade 71 to retain pusher rod 76 in fixed relation to cutter blade 71 as pusher rod 76 is slid past the cutting blade 24. A tension spring 85 pinned to basic frame 12A and pin 81 of pusher rod 76 maintains spring bias to return pusher rod 76 towards the cam shaped end 74 of the trigger arm 72.

A flat spring 86 mounted on basic frame 12A maintains spring bias against the flange 14 of the cutter frame 16 to bias the cutter frame 16 to the open position for disengaging the cutter wheel 24 from a can top.

Since obvious changes may be made in the specific embodiment of the invention described herein, such modifications being within the spirit and scope of the invention claimed, it is indicated that all matter contained herein is intended as illustrative and not as limiting in scope.

I claim:

1. A portable can opener tool in the outline shape of a pistol comprising a pistol-shaped basic frame, a cutter wheel frame pivotably mounted to the main frame, and a trigger handle pivotably mounted to the main frame, together with cutting blade means mounted on the cutter frame and can rim rotation means mounted on the basic frame linked to the trigger handle, in which the can rim rotation means comprises a slidable bar formed with serrated teeth on one edge and located so that some of the said serrated teeth bear, in use, against the undersurface of the rim of a can, the top of which is engaged by the cutter wheel, with said bar slidably linked to the basic frame so as to maintain substantically uniform spacing between the cutter wheel and the slidable bar when the bar travels in response to rotation of the trigger handle.

2. The combination as recited in claim 1 in which the trigger handle is formed with a cam shaped end section that bears against an end of the slidable bar so that rotation of the trigger handle causes the cam shaped end section to advance against the said end of the slidable bar to cause the bar to slide.

* * * * *